US005471691A

United States Patent [19]

Ryndak

[11] Patent Number: 5,471,691

[45] Date of Patent: Dec. 5, 1995

[54] MULTITIERED PILLOW CONSTRUCTION

[76] Inventor: James D. Ryndak, 3 Hickory La., Barrington Hills, Ill. 60010

[21] Appl. No.: 209,134

[22] Filed: Mar. 9, 1994

Related U.S. Application Data

[63] Continuation of Ser. No. 978,350, Nov. 18, 1992, abandoned.

[51] Int. Cl.[6] ..... A47C 23/00

[52] U.S. Cl. ..... 5/645; 5/636

[58] Field of Search ..... 5/636–645

[56] References Cited

U.S. PATENT DOCUMENTS

| | | | |
|---|---|---|---|
| 247,892 | 10/1881 | Doremus | 5/645 |
| 395,043 | 12/1888 | Doremus | 5/645 |
| 1,385,355 | 7/1921 | Banks | 5/636 |
| 1,701,124 | 2/1929 | Safford | 5/636 |
| 2,700,779 | 2/1955 | Tolkowsky | 5/636 |
| 2,720,660 | 10/1955 | Smith | 5/636 |
| 3,243,828 | 4/1966 | McCarty | 5/636 |
| 3,694,831 | 10/1972 | Treace | 5/636 |
| 3,849,810 | 11/1974 | Degen | 5/645 |
| 4,513,462 | 4/1985 | Thomas | 5/636 |
| 4,754,513 | 7/1988 | Rinz | 5/636 |
| 4,908,894 | 3/1990 | Sanders | 5/640 |
| 5,168,590 | 12/1992 | O'Sullivan | 5/636 |
| 5,271,114 | 10/1993 | Kjersem | 5/636 |

FOREIGN PATENT DOCUMENTS

| | | | |
|---|---|---|---|
| 2009792 | 11/1970 | Germany | 5/636 |

*Primary Examiner*—Flemming Saether
*Attorney, Agent, or Firm*—Jenner & Block

[57] ABSTRACT

A multitiered pillow is provided that is especially adapted for supporting the head of a person while sleeping. At least two tiers of different height are provided by the pillow to accommodate and properly support a person's head and neck regardless of whether the person is sleeping on his side (shoulders vertical) or prostrate (shoulders horizontal).

9 Claims, 2 Drawing Sheets

MULTITIERED PILLOW CONSTRUCTION

This application is a continuation of application Ser. No. 07/978,350, filed Nov. 18, 1992, abandoned.

FIELD OF THE INVENTION

The present invention relates to pillow constructions. More particularly, the present invention relates to having different thicknesses to accommodate a person's head and provides proper support for the head and neck for a person's vertical and horizontal sleeping positions.

BACKGROUND OF THE INVENTION

When sleeping, a person commonly uses a pillow for supporting the head and neck areas. The thickness of the pillow required for proper support varies from person to person because of shoulder width, head and neck size and weight. Moreover, the required thickness and support of a pillow depends on how the person is oriented when sleeping, such as whether a person's shoulders are horizontal or vertical. In the horizontal shoulder position, less support is required than in the vertical shoulder position because of the varying distance between the portion of the head adjacent the bed surface depending on the position of the shoulders.

Failure to provide the proper support of the head and neck while sleeping can result in a stiff neck and/or shoulders.

Some persons commonly sleep with two pillows laid on top of each other to increase the height of support that is provided. Such increased height may generally provide the proper support when the person's shoulders are in the vertical position, since the person's head is further away from the surface of the bed. However, when the person is in the horizontal shoulder position (prostrate), the pillow support surface is too high for the support height that is required. Thus, utilizing two stacked pillows also fails to provide proper sleeping positions when laying flat and prostrate.

A need exists for a pillow that provides optimum head and neck support regardless of a person's horizontal or vertical shoulder orientation while sleeping.

SUMMARY OF THE INVENTION

In accordance with the present invention, a pillow construction especially adapted for sleeping is provided that allows for optimum head and neck support of a sleeping person regardless of whether the person's shoulders are oriented in a vertical or horizontal position. Thus, a person's head is oriented with respect to the shoulders in a position similar to when a person is standing erect, regardless of whether the sleeping person is on his side (shoulders vertical to the bed surface) or prostrate (shoulders horizontal to the bed surface).

The pillow in accordance with the present invention is a multitiered pillow, preferably having at least two tiers, each tier being of generally uniform height. Preferably, the tiers comprise lower and upper tiers with the upper tier having a thickness of approximately two to three times the thickness or height of the first or lower tier.

The upper and lower tiers thus provide optimum sleeping support positions for the head and neck regardless of whether the sleeping person is laying down with the shoulders in a horizontal or vertical position. In accordance with one embodiment, a multi-tiered pillow is provided that is composed of an elongated compressible pillow body having a width and a depth, the pillow body defining a pillow top and a pillow bottom and at least first and second tiers, the second tier having an uncompressed height from the pillow bottom of at least about twice the uncompressed height from the pillow bottom of the first tier, the height of the first tier being suitable for supporting a person's head while in a prostrate position and the height of the second tier being suitable for supporting a person's head while laying on the side.

The elongated pillow body may be composed of a unitary mass of compressible material, such as foam rubber or other suitably compressible resilient material. Alternatively, the pillow body may be composed of a plurality of compartments that contain a pillow packing material, such as goose down or other suitable packing material. Preferably, the compartments are segregated from each other and each compartment is associated with only an upper tier or a lower tier for maintaining the proper relative tier height differential.

In one embodiment, the first and second tiers are each composed of a substantially flat plateau portion relative to the pillow bottom. The second or higher tier may further include a portion of decreasing height that extends from the substantially flat plateau portion of that tier. Also, the longitudinal pillow thickness may decrease along at least one of the longitudinal pillow ends. Preferably, the pillow bottom curves upwardly at the longitudinal end of decreasing thickness and is adjacent the portion of the second tier of decreasing height.

In accordance with another embodiment, the longitudinal cross section of the pillow body is U-shaped and includes two upper tiers separated by a lower tier.

In accordance with another embodiment, the pillow body defines a central upper tier and adjacent lower tiers on either longitudinal pillow side of the central upper tier.

In accordance with still another embodiment, the pillow body defines an upper tier on one longitudinal side of the pillow body and a lower tier on the other longitudinal side of the pillow body.

DETAILED DESCRIPTION

Figure 1:
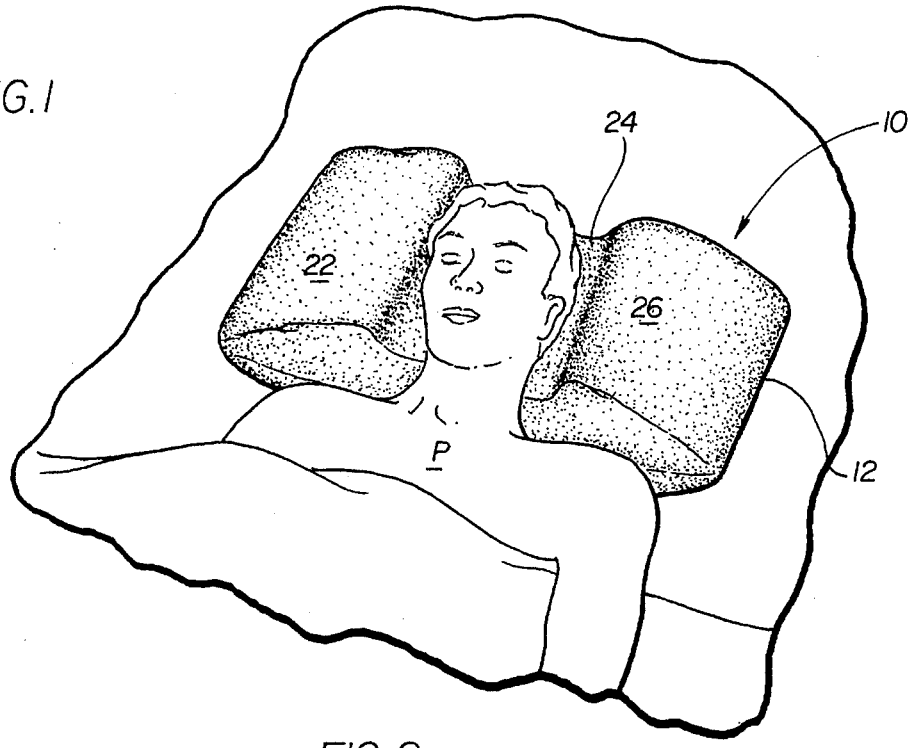
FIG. 1 illustrates in perspective view a pillow in accordance with the invention being utilized by a sleeping person.
Figure 2:
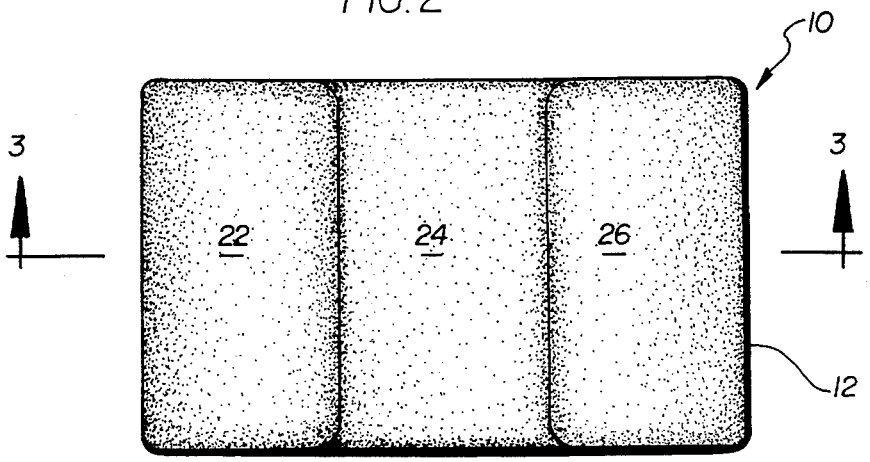
FIG. 2 illustrates a top plan view of the pillow of FIG. 1.
Figure 3:
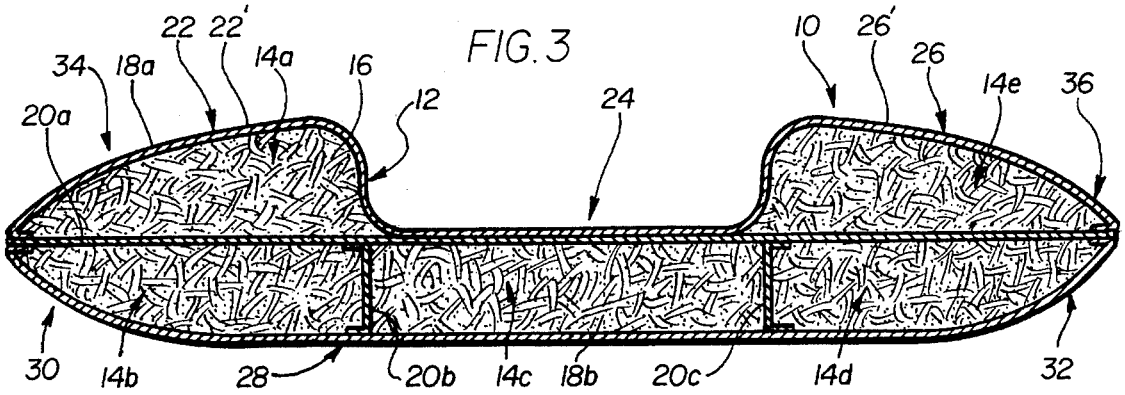
FIG. 3 illustrates a cross-sectional elevation view of the pillow of FIG. 2 along lines 3—3 of FIG. 2.

Referring to the Figures generally and in particular to FIGS. 1–3, there is illustrated a multi-tiered pillow 10 in accordance with the present invention. Multitiered pillow 10 defines an elongated pillow body. In the illustrated embodiment, multitiered pillow 10 is composed of a shell 12 defining a plurality of segregated compartments 14*a–e* extending the transverse width of pillow 10 for containing pillow packing material 16. Shell 12 is composed of outer panels 18*a–b* which defines the outer limits of multitiered pillow 10. Shell 12 is also composed of inner panels 20*a–c*. Inner panels 20*a–c* serve to segregate shell 12 into segregated compartments 14*a–e*. Typically, outer panels 18*a–b* and inner panels 20*a–c* can be any suitable fabric for pillow 10, such as cloth, for example, and can be fastened together by any suitable structure, such as by sewing, or adhesive, for example.

As illustrated in FIG. 3, shell 12 in combination with pillow packing material 16 defines a plurality of tiers, in this case an upper tier 22, a lower tier 24 and an upper tier 26, each extending across the transverse width of pillow 10.

Upper tiers 22 and 26 are of a suitable height for supporting a person's head and neck when the person is sleeping on his side and lower tier 24 is of a suitable height for supporting a person's head and neck when the person is sleeping in a prostrate position, such as person P in FIG. 1. Each of upper and lower tiers 22, 24 and 26 define a relatively flat plateau portion relative to bottom 28 of pillow 10. Bottom 28 of pillow 10 includes longitudinal ends 30 and 32 of decreasing thickness, as shown in FIG. 3. Longitudinal ends 30 and 32 are adjacent with the portion of upper tiers 22 and 26 that decrease in height from the substantially flat plateau portion of tiers 22 and 26 towards the

* * * * *

UNITED STATES PATENT AND TRADEMARK OFFICE

CERTIFICATE OF CORRECTION

PATENT NO. : 5,471,691
DATED : December 5, 1995
INVENTOR(S) : James D. Ryndak

It is certified that error appears in the above-identified patent and that said Letters Patent is hereby corrected as shown below:

Columns 1-4, should be deleted to be replaced with the attached pages.

Signed and Sealed this

Seventh Day of May, 1996

Bruce Lehman

*Attest:*

BRUCE LEHMAN

*Attesting Officer*

*Commissioner of Patents and Trademarks*

MULTITIERED PILLOW CONSTRUCTION

This application is a continuation of application Ser. No. 07/978,350, filed Nov. 18, 1992, abandoned.

FIELD OF THE INVENTION

The present invention relates to pillow constructions. More particularly, the present invention relates to having different thicknesses to accommodate a person's head and provides proper support for the head and neck for a person's vertical and horizontal sleeping positions.

BACKGROUND OF THE INVENTION

When sleeping, a person commonly uses a pillow for supporting the head and neck areas. The thickness of the pillow required for proper support varies from person to person because of shoulder width, head and neck size and weight. Moreover, the required thickness and support of a pillow depends on how the person is oriented when sleeping, such as whether a person's shoulders are horizontal or vertical. In the horizontal shoulder position, less support is required than in the vertical shoulder position because of the varying distance between the portion of the head adjacent the bed surface depending on the position of the shoulders.

Failure to provide the proper support of the head and neck while sleeping can result in a stiff neck and/or shoulders.

Some persons commonly sleep with two pillows laid on top of each other to increase the height of support that is provided. Such increased height may generally provide the proper support when the person's shoulders are in the vertical position, since the person's head is further away from the surface of the bed. However, when the person is in the horizontal shoulder position (prostrate), the pillow support surface is too high for the support height that is required. Thus, utilizing two stacked pillows also fails to provide proper sleeping positions when laying flat and prostrate.

A need exists for a pillow that provides optimum head and neck support regardless of a person's horizontal or vertical shoulder orientation while sleeping.

SUMMARY OF THE INVENTION

In accordance with the present invention, a pillow construction especially adapted for sleeping is provided that allows for optimum head and neck support of a sleeping person regardless of whether the person's shoulders are oriented in a vertical or horizontal position. Thus, a person's head is oriented with respect to the shoulders in a position similar to when a person is standing erect, regardless of whether the sleeping person is on his side (shoulders vertical to the bed surface) or prostrate (shoulders horizontal to the bed surface).

The pillow in accordance with the present invention is a multitiered pillow, preferably having at least two tiers, each tier being of generally uniform height. Preferably, the tiers comprise lower and upper tiers with the upper tier having a thickness of approximately two to three times the thickness or height of the first or lower tier.

The upper and lower tiers thus provide optimum sleeping support positions for the head and neck regardless of whether the sleeping person is laying down with the shoulders in a horizontal or vertical position. In accordance with one embodiment, a multi-tiered pillow is provided that is composed of an elongated compressible pillow body having a width and a depth, the pillow body defining a pillow top and a pillow bottom and a least first and second tiers, the second tier having an uncompressed height from the pillow bottom of at least about twice the uncompressed height from the pillow bottom of the first tier, the height of the first tier being suitable for supporting a person's head while in a prostrate position and the height of the second tier being suitable for supporting a person's head while laying on the side.

The elongated pillow body may be composed of a unitary mass of compressible material, such as foam rubber or other suitably compressible resilient material. Alternatively, the pillow body may be composed of a plurality of compartments that contain a pillow packing material, such as goose down or other suitable packing material. Preferably, the compartments are segregated from each other and each compartment is associated with only an upper tier or a lower tier for maintaining the proper relative tier height differential.

In one embodiment, the first and second tiers are each composed of a substantially flat plateau portion relative to the pillow bottom. The second or higher tier may further include a portion of decreasing height that extends from the substantially flat plateau portion of that tier. Also, the longitudinal pillow thickness may decrease along at least one of the longitudinal pillow ends. Preferably, the pillow bottom curves upwardly at the longitudinal end of decreasing thickness and is adjacent the portion of the second tier of decreasing height.

In accordance with another embodiment, the longitudinal cross section of the pillow body is U-shaped and includes two upper tiers separated by a lower tier.

In accordance with another embodiment, the pillow body defines a central upper tier and adjacent lower tiers on either longitudinal pillow side of the central upper tier.

In accordance with still another embodiment, the pillow body defines an upper tier on one longitudinal side of the pillow body and a lower tier on the other longitudinal side of the pillow body.

BRIEF DESCRIPTION OF THE DRAWINGS

Figure 4:
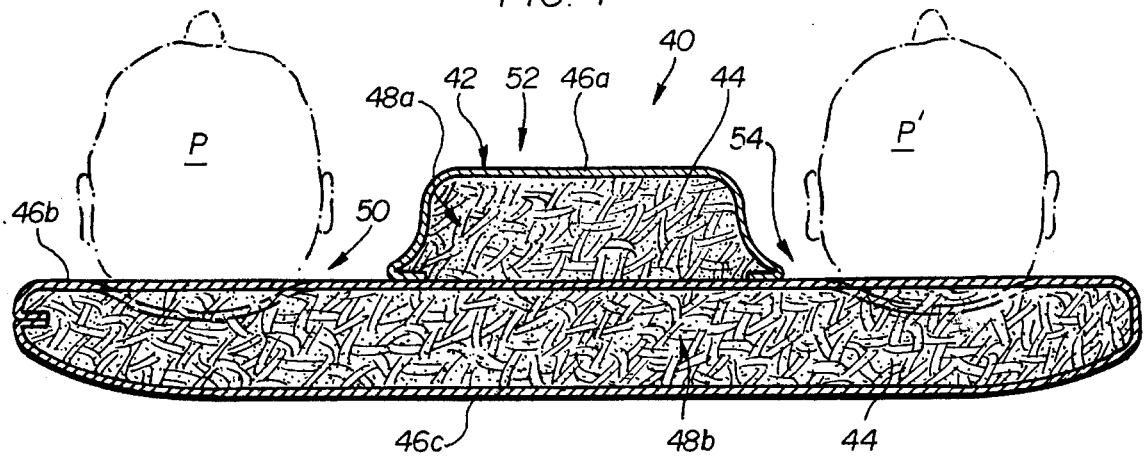
FIG. 4 illustrates a cross-sectional view of another pillow in accordance with the present invention.
Figure 5:
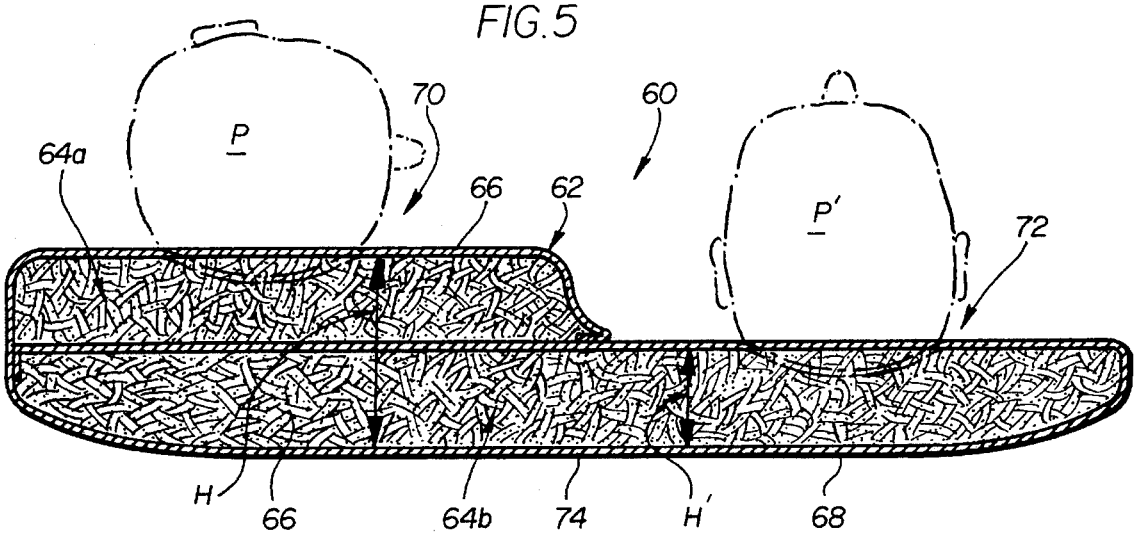
FIG. 5 illustrates a cross-sectional view of another embodiment of the pillow in accordance with the present invention.
Figure 6:
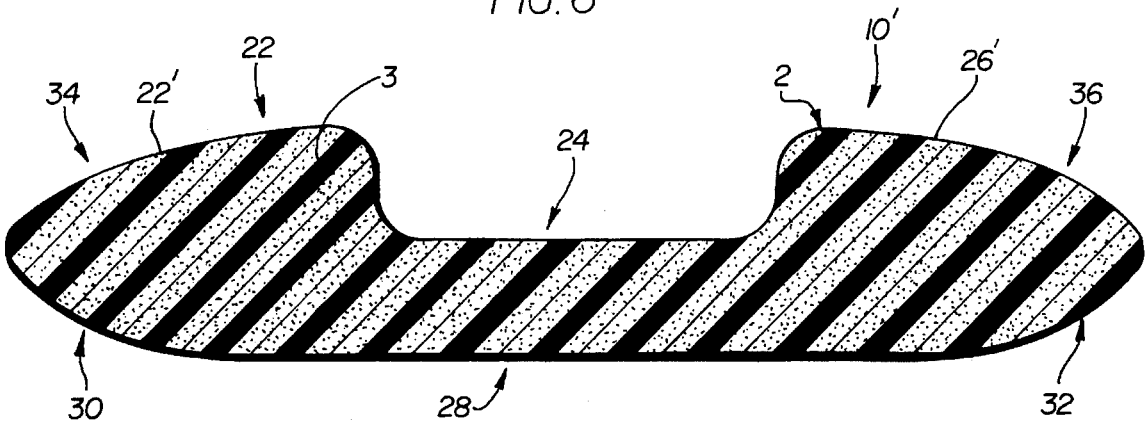
FIG. 6 illustrates a cross-sectional view of another pillow in accordance with the present invention.

FIG. 1 illustrates in perspective view a pillow in accordance with the invention being utilized by a sleeping person;

FIG. 2 illustrates a top plan view of the pillow of FIG. 1;

FIG. 3 illustrates a cross-sectional elevation view of the pillow of FIG. 2 along lines 3—3 of FIG. 2;

FIG. 4 illustrates a cross-sectional view of another pillow in accordance with the present invention;

FIG. 5 illustrates a cross-sectional view of another embodiment of the pillow in accordance with the present invention; and FIG. 6 illustrates a cross-sectional view of another pillow in accordance with the present invention.

DETAILED DESCRIPTION

Referring to the Figures generally and in particular to FIGS. 1–3, there is illustrated a multi-tiered pillow 10 in accordance with the present invention. Multitiered pillow 10 defines an elongated pillow body. In the illustrated embodiment, multitiered pillow 10 is composed of a shell 12 defining a plurality of segregated compartments 14*a–e* extending the transverse width of pillow 10 for containing pillow packing material 16. Shell 12 is composed of outer panels 18*a–e* which defines the outer limits of multitiered pillow 10. Shell 12 is also composed of inner panels 20a–c. Inner panels 20a–c serve to segregate shell 12 into segregated compartments 14a–e. Typically, outer panels 18a–b and inner panels 20a–c can be any suitable fabric for pillow 10, such as cloth, for example, and can be fastened together by any suitable structure, such as by sewing, or adhesive, for example.

As illustrated in FIG. 3, shell 12 in combination with pillow packing material 16 defines a plurality of tiers, in this case an upper tier 22, a lower tier 24 and an upper tier 26, each extending across the transverse width of pillow 10.

Upper tiers 22 and 26 are of a suitable height for supporting a person's head and neck when the person is sleeping on his side and lower tier 24 is of a suitable height for supporting a person's head and neck when the person is sleeping in a prostrate position, such as person P in FIG. 1. Each of upper and lower tiers 22, 24 and 26 define a relatively flat plateau portion relative to bottom 28 of pillow 10. Bottom 28 of pillow 10 includes longitudinal ends 30 and 32 of decreasing thickness, as shown in FIG. 3. Longitudinal ends 30 and 32 are adjacent with the portion of upper tiers 22 and 26 that decrease in height from the substantially flat plateau portion of tiers 22 and 26 towards the longitudinal ends of pillow 10. As a result, the longitudinal ends of pillow 10 provide an area of decreased thickness thereby providing a lower surface than the substantially flat plateau portions 22' and 26' of tiers 22 and 26. Thus, the longitudinal ends 34 and 36 of pillow 10 provide areas of decreased thickness yet are thicker and higher than lower tier 24, thereby providing an especially suitable height for supporting the head and neck of a person laying in between the prostrate and side positions.

Because segregated compartments 14a–e are each associated either with an upper tier (22 or 26) or a lower tier (24) and such compartments extend transversely of pillow 10 as do tiers 22–26, packing material 16 in a particular compartment 14a–e remains associated with that compartment thereby maintaining the integrity and shape of tiers 22–26.

Alternatively, multitiered pillow 10 could be constructed of a unitary mass of compressible material, such as foam rubber or other suitable material. Multitiered pillow 10' of FIG. 6 illustrates such an embodiment in which pillow 10' is constructed of a unitary mass 38 of foam rubber formed in a desired shape which is illustrated in FIGS. 1, 2 and 6. In the embodiment illustrated in FIG. 6, like reference numerals illustrate like shape, structure and surface contours as set forth in FIG. 3.

Referring to FIG. 4, there is illustrated another multitiered pillow 40 in accordance with the present invention. As illustrated, multitiered pillow 40 is composed of a shell 42 and pillow packing material 44. Shell 42 defines the shape of multitiered pillow 40 and is composed of panels 46a–c. Panels 46a–c also define segregated compartments 48a–b which define the multi-tiers of pillow 40, in this case lower tier 50, upper tier 52 and lower tier 54.

As illustrated, compartment 48a is associated only with upper tier 52, thereby preventing pillow packing material 44 adjacent upper tier 52 from migrating to either of lower tiers 50 and 54. As illustrated, lower tiers 50 and 54 are especially suitable for supporting the head and neck of a person P and P' when in the prostrate position. Also, upper tier 52 is especially suitable for supporting the head and neck of a person (not shown) when laying sideways with the head and neck resting on upper tier 52.

Referring to FIG. 5, there is illustrated another embodiment in accordance with the invention. A multi tiered pillow 60 is provided. Multitiered pillow 60 is composed of a shell 62 that defines segregated compartments 64a–b that contain pillow packing material 66. Shell 62 is composed of a single piece of fabric 68 which is folded over onto itself and spaced apart as illustrated in FIG. 5 to form compartments 64a and 64b.

Shell 62 thereby defines, in combination with packing material 66 an upper tier 70 and a lower tier 72. Upper tier 70 is especially suitable for supporting the head and neck of a person P laying on his side while lower tier 72 is especially suitable for supporting the head and neck portions of a person P' laying on his back.

Preferably, the uncompressed height H of upper tier 70 as measured from the bottom 74 of pillow 60 is at least about twice the uncompressed height H' of lower tier 72 also as measured from bottom 74 of pillow 60. Generally, the height of the upper tier may be two to three times or more the uncompressed height of the lower tier in accordance with the invention.

While the invention has been described with respect to certain preferred embodiments, it is to be understood that the invention is capable of numerous rearrangements, substitutions and changes that are within the scope of the following claims and it is intended that the invention cover all such changes, rearrangements and modifications.

I claim:

1. A compressible pillow comprising an elongated compartmented pillow shell containing pillow packing material and having a pillow top and a pillow bottom and defining a central lower plateau and opposed adjacent upper plateaus located on either side of the central plateau, each of said plateaus having a different height, the height of the lower plateau being suitable for supporting a person's head while the person lays in a prostrate position, the height of the upper plateau being suitable for supporting a person's head while a person lays sideways and the upper plateau being greater in height than the lower plateau, the pillow shell compartmented into a plurality of segregated pillow shell compartments, each compartment containing pillow packing material and each shell compartment associated with only one plateau for preventing movement of the packing material between the lower and upper plateaus, wherein the lower plateau is defined by a central pillow shell compartment and each upper plateau is defined by a bottom pillow shell compartment and a top pillow shell compartment above the bottom pillow shell compartment.

2. The pillow of claim 1 wherein the uncompressed height of the upper plateau is from about two to three times the uncompressed height of the lower plateau as measured from the bottom of the pillow.

3. A compressible pillow comprising an elongated compartmented pillow shell containing pillow packing material and having a pillow top and a pillow bottom and defining a lower plateau and an upper plateau, each of said plateaus having a different height, the height of the lower plateau being suitable for supporting a person's head while the person lays in a prostrate position, the height of the upper plateau being suitable for supporting a person's head while a person lays sideways and the upper plateau being greater in height than the lower plateau, the pillow shell compartmented into a plurality of segregated pillow shell compartments, each compartment containing pillow packing material and each shell compartment associated with only one plateau for preventing movement of the packing material between the lower and upper plateaus, wherein the uncompressed height of the upper plateau is about twice the height of the uncompressed lower plateau and wherein the lower plateau is a central lower plateau and the pillow further includes opposed adjacent upper plateaus located on either side of the central lower plateau.

4. The pillow of claim 3, wherein said compartments comprise three lower adjacent compartments and one upper compartment located over at least a portion of one of the lower compartments.

5. The pillow of claim 3 wherein said compartments comprise one lower compartment and one upper compartment.

6. The pillow of claim 5 having a length wherein the lower compartment defines the length of the pillow and the upper compartment extends over about one-half of the length.

7. The pillow of claim 6 wherein the upper compar ment extends longitudinally from one side of the pillo to about the longitudinal center of the pillow.

8. The pillow of claim 6 wherein the upper and lowe compartments are formed from a single piece of fabri 9. A compressible pillow comprising an elongate compartmented pillow shell containing pillow packin material and having a pillow top and a pillow botto and defining a lower plateau and an upper plateau, eac of said plateaus having a different height, the height c the lower plateau being suitable for supporting a pe son's head while the person lays in a prostrate positio the height of the upper plateau being suitable for sup porting a person's head while a person lays sideway and the upper plateau being greater in height than th lower plateau, the pillow shell compartmented into plurality of segregated pillow shell compartments, eac compartment containing pillow packing material an each shell compartment associated with only one pla teau for preventing movement of the packing materia between the lower and upper plateaus, wherein th uncompressed height of the upper plateau is about twic the height of the uncompressed lower plateau, sai compartments comprising one lower compartment an one upper compartment wherein the upper compart ment is centrally located over the lower compartment

* * * * *